US008512434B2

(12) United States Patent
Stelter et al.

(10) Patent No.: US 8,512,434 B2
(45) Date of Patent: Aug. 20, 2013

(54) MOLDED MONOCOMPONENT MONOLAYER RESPIRATOR

(75) Inventors: John D. Stelter, St. Joseph Township, WI (US); Andrew R. Fox, Oakdale, MN (US); Seyed A. Angadjivand, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 303 days.

(21) Appl. No.: 13/019,500

(22) Filed: Feb. 2, 2011

(65) Prior Publication Data

US 2011/0132374 A1 Jun. 9, 2011

Related U.S. Application Data

(62) Division of application No. 11/461,128, filed on Jul. 31, 2006, now Pat. No. 7,905,973.

(51) Int. Cl.
*B01D 39/14* (2006.01)

(52) U.S. Cl.
USPC ..... 55/524; 55/DIG. 33; 55/DIG. 35; 55/528; 128/200.24

(58) Field of Classification Search
None
See application file for complete search history.

(56) References Cited

U.S. PATENT DOCUMENTS

| | | | |
|---|---|---|---|
| 3,715,251 | A | 2/1973 | Prentice |
| 3,981,650 | A | 9/1976 | Page |
| 4,100,324 | A | 7/1978 | Anderson et al. |
| 4,118,531 | A | 10/1978 | Hauser |
| 4,405,297 | A | 9/1983 | Appel et al. |
| 4,536,440 | A | 8/1985 | Berg |
| 4,547,420 | A | 10/1985 | Krueger et al. |
| 4,588,537 | A | 5/1986 | Klaase et al. |
| 4,714,647 | A | 12/1987 | Shipp, Jr. et al. |
| 4,795,668 | A | 1/1989 | Krueger |
| 4,807,619 | A | 2/1989 | Dyrud et al. |
| 4,818,464 | A | 4/1989 | Lau |
| 4,931,355 | A | 6/1990 | Radwanski et al. |
| 4,988,560 | A | 1/1991 | Meyer et al. |
| 5,079,080 | A | 1/1992 | Schwarz |
| 5,082,720 | A | 1/1992 | Hayes |
| 5,227,107 | A | 7/1993 | Dickenson et al. |

(Continued)

FOREIGN PATENT DOCUMENTS

| | | |
|---|---|---|
| EP | 0 322 136 B1 | 2/1994 |
| EP | 0799342 | 9/1999 |

(Continued)

OTHER PUBLICATIONS

Supplemental European Search Report for Application No. EP07871007 dated Oct. 27, 2011.

*Primary Examiner* — Duane Smith
*Assistant Examiner* — Phillip Shao
(74) *Attorney, Agent, or Firm* — Karl G. Hanson

(57) ABSTRACT

A molded respirator is made from a monocomponent monolayer nonwoven web of continuous charged monocomponent meltspun partially crystalline and partially amorphous oriented fibers of the same polymeric composition that have been bonded to form a coherent and handleable web which further may be softened while retaining orientation and fiber structure. The respirator is a cup-shaped porous monocomponent monolayer matrix whose matrix fibers are bonded to one another at at least some points of fiber intersection. The matrix has a King Stiffness greater than 1 N. The respirator may be formed without requiring stiffening layers, bicomponent fibers, or other reinforcement in the filter media layer.

8 Claims, 4 Drawing Sheets

(56) References Cited

U.S. PATENT DOCUMENTS

| | | | | |
|---|---|---|---|---|
| 5,307,796 | A | 5/1994 | Kronzer | |
| 5,374,458 | A | 12/1994 | Burgio | |
| 5,382,400 | A | 1/1995 | Pike et al. | |
| 5,496,507 | A | 3/1996 | Angadjivand et al. | |
| 5,582,907 | A | 12/1996 | Pall | |
| 5,597,645 | A * | 1/1997 | Pike et al. | 96/99 |
| 5,679,042 | A | 10/1997 | Varona | |
| 5,679,379 | A | 10/1997 | Fabbricante et al. | |
| 5,681,469 | A | 10/1997 | Barboza et al. | |
| 5,685,757 | A | 11/1997 | Kirsch et al. | |
| 5,695,376 | A | 12/1997 | Datta et al. | |
| 5,707,468 | A | 1/1998 | Arnold et al. | |
| 5,721,180 | A | 2/1998 | Pike et al. | |
| 5,753,736 | A | 5/1998 | Bhat | |
| 5,817,584 | A | 10/1998 | Singer et al. | |
| 5,877,098 | A | 3/1999 | Tanaka et al. | |
| 5,902,540 | A | 5/1999 | Kwok | |
| 5,904,298 | A | 5/1999 | Kwok et al. | |
| 5,908,598 | A | 6/1999 | Rousseau et al. | |
| 5,993,543 | A | 11/1999 | Aoki et al. | |
| 5,993,943 | A | 11/1999 | Bodaghi et al. | |
| 6,102,039 | A | 8/2000 | Springett et al. | |
| 6,176,955 | B1 | 1/2001 | Haynes et al. | |
| 6,183,670 | B1 | 2/2001 | Torobin et al. | |
| 6,214,094 | B1 * | 4/2001 | Rousseau et al. | 96/15 |
| 6,230,901 | B1 | 5/2001 | Ogata et al. | |
| 6,274,238 | B1 | 8/2001 | DeLucia | |
| 6,315,806 | B1 | 11/2001 | Torobin et al. | |
| 6,319,865 | B1 | 11/2001 | Mikami | |
| 6,397,458 | B1 | 6/2002 | Jones et al. | |
| 6,398,847 | B1 | 6/2002 | Jones et al. | |
| 6,409,806 | B1 | 6/2002 | Jones et al. | |
| 6,562,112 | B2 | 5/2003 | Jones et al. | |
| 6,607,624 | B2 | 8/2003 | Berrigan et al. | |
| 6,667,254 | B1 | 12/2003 | Thompson et al. | |
| 6,723,669 | B1 | 4/2004 | Clark et al. | |
| 6,770,356 | B2 * | 8/2004 | O'Donnell et al. | 428/297.4 |
| 6,827,764 | B2 * | 12/2004 | Springett et al. | 96/66 |
| 6,858,297 | B1 | 2/2005 | Shah et al. | |
| 6,916,752 | B2 | 7/2005 | Berrigan et al. | |
| 6,998,164 | B2 | 2/2006 | Neely et al. | |
| 7,858,163 | B2 | 12/2010 | Angadjivand et al. | |
| 2003/0114066 | A1 | 6/2003 | Clark et al. | |
| 2003/0134515 | A1 | 7/2003 | David et al. | |
| 2003/0162457 | A1 | 8/2003 | Berrigan et al. | |
| 2004/0097155 | A1 | 5/2004 | Olson et al. | |
| 2008/0026172 | A1 | 1/2008 | Stelter et al. | |
| 2008/0026659 | A1 | 1/2008 | Brandner et al. | |
| 2009/0255542 | A1 * | 10/2009 | Ugai et al. | 128/863 |

FOREIGN PATENT DOCUMENTS

| | | | |
|---|---|---|---|
| JP | 61-103454 | | 5/1986 |
| JP | 1-321916 | A1 | 12/1989 |
| JP | 9-192248 | | 10/1996 |
| JP | 2001-049560 | | 2/2001 |
| JP | 2001-525201 | A2 | 12/2001 |
| JP | 2002-348737 | | 4/2002 |
| JP | 2002-180331 | | 6/2002 |
| JP | 2005-013492 | | 1/2005 |
| JP | 2006-149739 | | 6/2006 |
| JP | 2007054778 | | 3/2007 |
| WO | WO 02/46504 | A1 | 6/2002 |
| WO | WO 2005/111291 | A1 | 2/2005 |
| WO | WO 2007/112877 | A2 | 10/2007 |

* cited by examiner

MOLDED MONOCOMPONENT MONOLAYER RESPIRATOR

CROSS REFERENCE TO RELATED APPLICATION

This application is a divisional of U.S. Ser. No. 11/461,128, filed Jul. 31, 2006, now U.S. Pat. No. 7,905,973 the disclosure of which is incorporated by reference in its entirety herein.

This invention relates to molded (e.g., cup-shaped) personal respirators.

BACKGROUND

Patents relating to molded personal respirators include U.S. Pat. No. 4,536,440 (Berg), U.S. Pat. No. 4,547,420 (Krueger et al.), U.S. Pat. No. 5,374,458 (Burgio) and U.S. Pat. No. 6,827,764 B2 (Springett et al.). Patents relating to breathing mask fabrics include U.S. Pat. No. 5,817,584 (Singer et al.), U.S. Pat. No. 6,723,669 (Clark et al.) and U.S. Pat. No. 6,998,164 B2 (Neely et al.). Other patents or applications relating to nonwoven webs or their manufacture include U.S. Pat. No. 3,981,650 (Page), U.S. Pat. No. 4,100,324 (Anderson), U.S. Pat. No. 4,118,531 (Hauser), U.S. Pat. No. 4,818,464 (Lau), U.S. Pat. No. 4,931,355 (Radwanski et al.), U.S. Pat. No. 4,988,560 (Meyer et al.), U.S. Pat. No. 5,227,107 (Dickenson et al.), U.S. Pat. No. 5,382,400 (Pike et al. '400), U.S. Pat. No. 5,679,042 (Varona), U.S. Pat. No. 5,679,379 (Fabbricante et al.), U.S. Pat. No. 5,695,376 (Datta et al.), U.S. Pat. No. 5,707,468 (Arnold et al.), U.S. Pat. No. 5,721,180 (Pike et al. '180), U.S. Pat. No. 5,877,098 (Tanaka et al.), U.S. Pat. No. 5,902,540 (Kwok), U.S. Pat. No. 5,904,298 (Kwok et al.), U.S. Pat. No. 5,993,543 (Bodaghi et al.), U.S. Pat. No. 6,176,955 B1 (Haynes et al.), U.S. Pat. No. 6,183,670 B1 (Torobin et al.), U.S. Pat. No. 6,230,901 B1 (Ogata et al.), U.S. Pat. No. 6,319,865 B1 (Mikami), U.S. Pat. No. 6,607,624 B2 (Berrigan et al. '624), U.S. Pat. No. 6,667,254 B1 (Thompson et al.), U.S. Pat. No. 6,858,297 B1 (Shah et al.) and U.S. Pat. No. 6,916,752 B2 (Berrigan et al. '752); European Patent No. EP 0 322 136 B1 (Minnesota Mining and Manufacturing Co.); Japanese published application Nos. JP 2001-049560 (Nissan Motor Co. Ltd.), JP 2002-180331 (Chisso Corp. '331) and JP 2002-348737 (Chisso Corp. '737); and U.S. Patent Application Publication No. US2004/0097155 A1 (Olson et al.).

SUMMARY OF THE INVENTION

Existing methods for manufacturing molded respirators generally involve some compromise of web or respirator properties. Setting aside for the moment any inner or outer cover layers used for comfort or aesthetic purposes and not for filtration or stiffening, the remaining layer or layers of the respirator may have a variety of constructions. For example, molded respirators may be formed from bilayer webs made by laminating a meltblown fiber filtration layer to a stiff shell material such as a meltspun layer or staple fiber layer. If used by itself, the filtration layer normally has insufficient rigidity to permit formation of an adequately strong cup-shaped finished molded respirator. The reinforcing shell material also adds undesirable basis weight and bulk, and limits the extent to which unused portions of the web laminate may be recycled. Molded respirators may also be formed from monolayer webs made from bicomponent fibers in which one fiber component can be charged to provide a filtration capability and the other fiber component can be bonded to itself to provide a reinforcing capability. As is the case with a reinforcing shell material, the bonding fiber component adds undesirable basis weight and bulk and limits the extent to which unused portions of the bicomponent fiber web may be recycled. The bonding fiber component also limits the extent to which charge may be placed on the bicomponent fiber web. Molded respirators may also be formed by adding an extraneous bonding material (e.g., an adhesive) to a filtration web, with consequent limitations due to the chemical or physical nature of the added bonding material including added web basis weight and loss of recyclability.

Prior attempts to form molded respirators from monocomponent, monolayer webs have typically been unsuccessful. It has turned out to be quite difficult to obtain an appropriate combination of moldability, adequate stiffness after molding, suitably low pressure drop and sufficient particulate capture efficiency. We have now found monocomponent, monolayer webs which can be so molded to provide useful cup-shaped personal respirators.

The invention provides in one aspect a process for making a molded respirator comprising:

a) forming a monocomponent monolayer nonwoven web of continuous monocomponent polymeric fibers by meltspinning, collecting, heating and quenching the monocomponent polymeric fibers under thermal conditions sufficient to form a web of partially crystalline and partially amorphous oriented meltspun fibers of the same polymeric composition that are bonded to form a coherent and handleable web which further may be softened while retaining orientation and fiber structure, b) charging the web, and c) molding the charged web to form a cup-shaped porous monocomponent monolayer matrix, the matrix fibers being bonded to one another at at least some points of fiber intersection and the matrix having a King Stiffness greater than 1 N.

The invention provides in another aspect a molded respirator comprising a cup-shaped porous monocomponent monolayer matrix of continuous charged monocomponent polymeric fibers, the fibers being partially crystalline and partially amorphous oriented meltspun polymeric fibers of the same polymeric composition bonded to one another at at least some points of fiber intersection and the matrix having a King Stiffness greater than 1 N.

The disclosed cup-shaped matrix has a number of beneficial and unique properties. For example, a finished molded respirator may be prepared consisting only of a single layer, but comprising a mixture of partially crystalline and partially amorphous oriented polymeric charged fibers, and having improved moldability and reduced loss of filtration performance following molding. Such molded respirators offer important efficiencies—product complexity and waste are reduced by eliminating laminating processes and equipment and by reducing the number of intermediate materials. By using direct-web-formation manufacturing equipment, in which a fiber-forming polymeric material is converted into a web in one essentially direct operation, the disclosed webs and matrices can be quite economically prepared. Also, if the matrix fibers all have the same polymeric composition and extraneous bonding materials are not employed, the matrix can be fully recycled.

These and other aspects of the invention will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWING

Like reference symbols in the various figures of the drawing indicate like elements. The elements in the drawing are not to scale.

DETAILED DESCRIPTION

Figure 1:
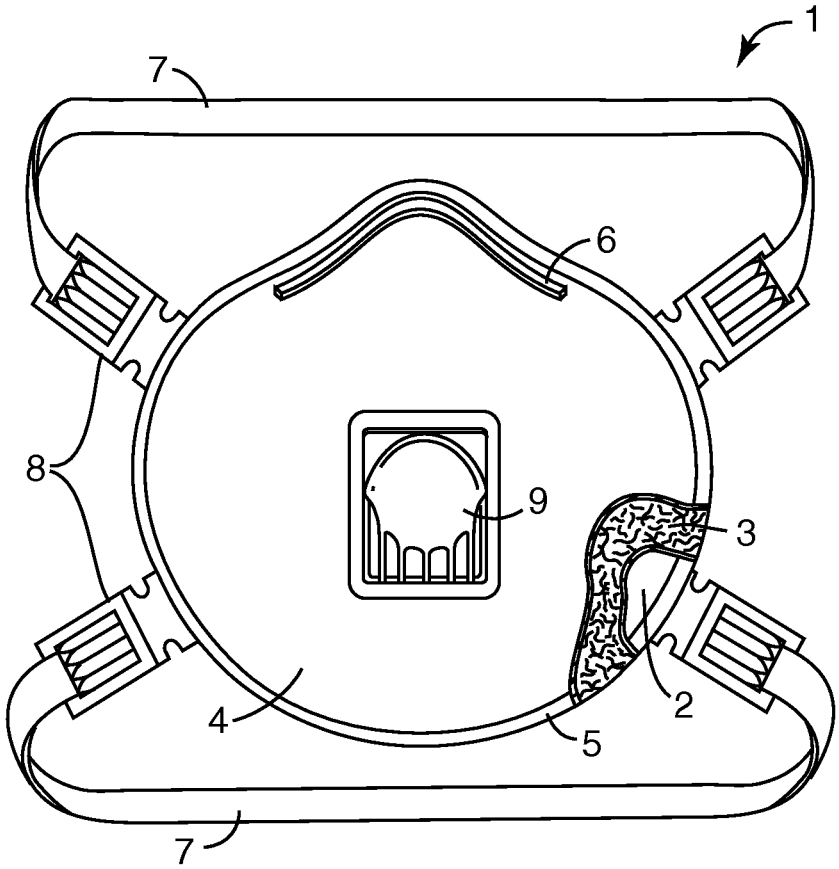
FIG. 1 is a perspective view, partially in section, of a disposable personal respirator having a deformation-resistant cup-shaped porous monolayer matrix disposed between inner and outer cover layers.

The term "molded respirator" means a device that has been molded to a shape that fits over at least the nose and mouth of a person and that removes one or more airborne contaminants when worn by a person.

The term "cup-shaped" when used with respect to a respirator mask body means having a configuration that allows the mask body to be spaced from a wearer's face when worn.

The term "porous" means air-permeable.

The term "monocomponent" when used with respect to a fiber or collection of fibers means fibers having essentially the same composition across their cross-section; monocomponent includes blends (viz., polymer alloys) or additive-containing materials, in which a continuous phase of uniform composition extends across the cross-section and over the length of the fiber.

The term "of the same polymeric composition" means polymers that have essentially the same repeating molecular unit, but which may differ in molecular weight, melt index, method of manufacture, commercial form, etc.

The term "bonding" when used with respect to a fiber or collection of fibers means adhering together firmly; bonded fibers generally do not separate when a web is subjected to normal handling.

The term "nonwoven web" means a fibrous web characterized by entanglement or point bonding of the fibers.

The term "monolayer matrix" when used with respect to a nonwoven web of fibers means having a generally uniform distribution of similar fibers throughout a cross-section thereof.

The term "size" when used with respect to a fiber means the fiber diameter for a fiber having a circular cross section, or the length of the longest cross-sectional chord that may be constructed across a fiber having a non-circular cross-section.

The term "continuous" when used with respect to a fiber or collection of fibers means fibers having an essentially infinite aspect ratio (viz., a ratio of length to size of e.g., at least about 10,000 or more).

The term "Effective Fiber Diameter" when used with respect to a collection of fibers means the value determined according to the method set forth in Davies, C. N., *The Separation of Airborne Dust and Particles*, Institution of Mechanical Engineers, London, Proceedings 1B, 1952 for a web of fibers of any cross-sectional shape be it circular or non-circular.

The term "attenuating the filaments into fibers" means the conversion of a segment of a filament into a segment of greater length and smaller size.

The term "meltspun" when used with respect to a nonwoven web means a web formed by extruding a low viscosity melt through a plurality of orifices to form filaments, quenching the filaments with air or other fluid to solidify at least the surfaces of the filaments, contacting the at least partially solidified filaments with air or other fluid to attenuate the filaments into fibers and collecting a layer of the attenuated fibers.

The term "meltspun fibers" means fibers issuing from a die and traveling through a processing station in which the fibers are permanently drawn and polymer molecules within the fibers are permanently oriented into alignment with the longitudinal axis of the fibers. Such fibers are essentially continuous and are entangled sufficiently that it is usually not possible to remove one complete meltspun fiber from a mass of such fibers.

The term "oriented" when used with respect to a polymeric fiber or collection of such fibers means that at least portions of the polymeric molecules of the fibers are aligned lengthwise of the fibers as a result of passage of the fibers through equipment such as an attenuation chamber or mechanical drawing machine. The presence of orientation in fibers can be detected by various means including birefringence measurements or wide-angle x-ray diffraction.

The term "Nominal Melting Point" for a polymer or a polymeric fiber means the peak maximum of a second-heat, total-heat-flow differential scanning calorimetry (DSC) plot in the melting region of the polymer or fiber if there is only one maximum in that region; and, if there is more than one maximum indicating more than one melting point (e.g., because of the presence of two distinct crystalline phases), as the temperature at which the highest-amplitude melting peak occurs.

The term "autogenous bonding" means bonding between fibers at an elevated temperature as obtained in an oven or with a through-air bonder without application of solid contact pressure such as in point-bonding or calendering.

The term "microfibers" means fibers having a median size (as determined using microscopy) of 10 μm or less; "ultrafine microfibers" means microfibers having a median size of two μm or less; and "submicron microfibers" means microfibers having a median size one μm or less. When reference is made herein to a batch, group, array, etc. of a particular kind of microfiber, e.g., "an array of submicron microfibers," it means the complete population of microfibers in that array, or the complete population of a single batch of microfibers, and not only that portion of the array or batch that is of submicron dimensions.

The term "charged" when used with respect to a collection of fibers means fibers that exhibit at least a 50% loss in Quality Factor QF (discussed below) after being exposed to a 20 Gray absorbed dose of 1 mm beryllium-filtered 80 KVp X-rays when evaluated for percent dioctyl phthalate (% DOP) penetration at a face velocity of 7 cm/sec.

The term "self-supporting" when used with respect to a monolayer matrix means that the matrix does not include a contiguous reinforcing layer of wire, plastic mesh, or other stiffening material even if a molded respirator containing such matrix may include an inner or outer cover web to provide an appropriately smooth exposed surface or may include weld lines, folds or other lines of demarcation to strengthen selected portions of the respirator.

The term "King Stiffness" means the force required using a King Stiffness Tester from J. A. King & Co., Greensboro, N.C. to push a flat-faced, 2.54 cm diameter by 8.1 m long probe against a molded cup-shaped respirator prepared by forming a test cup-shaped matrix between mating male and female halves of a hemispherical mold having a 55 mm radius and a 310 $cm^3$ volume. The molded matrices are placed under the tester probe for evaluation after first being allowed to cool.

Referring to FIG. 1, a cup-shaped disposable personal respirator 1 is shown in partial cross-section. Respirator 1 includes inner cover web 2, monocomponent filtration layer 3, and outer cover layer 4. Welded edge 5 holds these layers together and provides a face seal region to reduce leakage past the edge of respirator 1. Leakage may be further reduced by pliable dead-soft nose band 6 of for example a metal such as aluminum or a plastic such as polypropylene Respirator 1 also includes adjustable head and neck straps 7 fastened using tabs 8, and exhalation valve 9. Aside from the monocomponent filtration layer 2, further details regarding the construction of respirator 1 will be familiar to those skilled in the art.

The disclosed monocomponent monolayer web may have a variety of Effective Fiber Diameter (EFD) values, for example an EFD of about 5 to about 40 μm, or of about 8 to about 35 μm. The web may also have a variety of basis weights, for example a basis weight of about 60 to about 300 grams/$m^2$ or of about 80 to about 250 grams/$m^2$. When flat (viz., unmolded), the web may have a variety of Gurley Stiffness values, for example a Gurley Stiffness of at least about 500 mg, at least about 1000 mg or at least about 2000 mg. When evaluated at a 13.8 cm/sec face velocity and using an NaCl challenge, the flat web preferably has an initial filtration quality factor QF of at least about 0.4 $mm^{-1}$ $H_2O$ and more preferably at least about 0.5 $mm^{-1}$ $H_2O$.

The molded matrix has a King Stiffness greater than 1 N and more preferably at least about 2 N or more. As a rough approximation, if a hemispherical molded matrix sample is allowed to cool, placed cup-side down on a rigid surface, depressed vertically (viz., dented) using an index finger and then the pressure released, a matrix with insufficient King Stiffness may tend to remain dented and a matrix with adequate King Stiffness may tend to spring back to its original hemispherical configuration.

When exposed to a 0.075 μm sodium chloride aerosol flowing at an 85 liters/min flow rate, the disclosed molded respirator preferably has a pressure drop less than 20 mm $H_2O$ and more preferably less than 10 mm $H_2O$. When so evaluated, the molded respirator preferably has a % NaCl penetration less than about 5%, and more preferably less than about 1%.

The disclosed monocomponent monolayer web contains partially crystalline and partially amorphous oriented fibers of the same polymeric composition. Partially crystalline oriented fibers may also be referred to as semicrystalline oriented fibers. The class of semicrystalline polymers is well defined and well known and is distinguished from amorphous polymers, which have no detectable crystalline order. The existence of crystallinity can be readily detected by differential scanning calorimetry, x-ray diffraction, density and other methods. Conventional oriented semicrystalline polymeric fibers may be considered to have two different kinds of molecular regions or phases: a first kind of phase that is characterized by the relatively large presence of highly ordered, or strain-induced, crystalline domains, and a second kind of phase that is characterized by a relatively large presence of domains of lower crystalline order (e.g., not chain-extended) and domains that are amorphous, though the latter may have some order or orientation of a degree insufficient for crystallinity. These two different kinds of phases, which need not have sharp boundaries and can exist in mixture with one another, have different kinds of properties. The different properties include different melting or softening characteristics: the first phase characterized by a larger presence of highly ordered crystalline domains melts at a temperature (e.g., the melting point of a chain-extended crystalline domain) that is higher than the temperature at which the second phase melts or softens (e.g., the glass transition temperature of the amorphous domain as modified by the melting points of the lower-order crystalline domains). For ease of description herein, the first phase is termed herein the "crystallite-characterized phase" because its melting characteristics are more strongly influenced by the presence of the higher order crystallites, giving the phase a higher melting point than it would have without the crystallites present; the second phase is termed the "amorphous-characterized phase" because it softens at a lower temperature influenced by amorphous molecular domains or of amorphous material interspersed with lower-order crystalline domains. The bonding characteristics of oriented semicrystalline polymeric fibers are influenced by the existence of the two different kinds of molecular phases. When the semicrystalline polymeric fibers are heated in a conventional bonding operation, the heating operation has the effect of increasing the crystallinity of the fibers, e.g., through accretion of molecular material onto existing crystal structure or further ordering of the ordered amorphous portions. The presence of lower-order crystalline material in the amorphous-characterized phase promotes such crystal growth, and promotes it as added lower-order crystalline material. The result of the increased lower-order crystallinity is to limit softening and flowability of the fibers during a bonding operation.

We subject the oriented semicrystalline polymeric fibers to a controlled heating and quenching operation in which the fibers, and the described phases, are morphologically refined to give the fibers new properties and utility. In this heating and quenching operation the fibers are first heated for a short controlled time at a rather high temperature, often as high or higher than the Nominal Melting Point of the polymeric material from which the fibers are made. Generally the heating is at a temperature and for a time sufficient for the amorphous-characterized phase of the fibers to melt or soften while the crystallite-characterized phase remains unmelted (we use the terminology "melt or soften" because amorphous portions of an amorphous-characterized phase generally are considered to soften at their glass transition temperature, while crystalline portions melt at their melting point; we prefer a heat treatment in which a web is heated to cause melting of crystalline material in the amorphous-characterized phase of constituent fibers). Following the described heating step, the heated fibers are immediately and rapidly cooled to quench and freeze them in a refined or purified morphological form.

In broadest terms "morphological refining" as used herein means simply changing the morphology of oriented semicrystalline polymeric fibers; but we understand the refined morphological structure of our treated fibers (we do not wish to be bound by statements herein of our "understanding," which generally involve some theoretical considerations). As to the amorphous-characterized phase, the amount of molecular material of the phase susceptible to undesirable (softening-impeding) crystal growth is not as great as it was before treatment. One evidence of this changed morphological character is the fact that, whereas conventional oriented semicrystalline polymeric fibers undergoing heating in a bonding operation experience an increase in undesired crystallinity (e.g., as discussed above, through accretion onto existing lower-order crystal structure or further ordering of ordered amorphous portions that limits the softenability and bondability of the fibers), our treated fibers remain softenable and bondable to a much greater degree than conventional untreated fibers; often they can be bonded at temperatures lower than the nominal melting point of the fibers. We perceive that the amorphous-characterized phase has experienced a kind of cleansing or reduction of morphological structure that would lead to undesirable increases in crystallinity in conventional untreated fibers during a thermal bonding operation; e.g., the variety or distribution of morphological forms has been reduced, the morphological structure simplified, and a kind of segregation of the morphological structure into more discernible amorphous-characterized and crystallite-characterized phases has occurred. Our treated fibers are capable of a kind of "repeatable softening," meaning that the fibers, and particularly the amorphous-characterized phase of the fibers, will undergo to some degree a repeated cycle of softening and resolidifying as the fibers are exposed to a cycle of raised and lowered temperature within a temperature region lower than that which would cause melting of the whole fiber. In practical terms, such repeatable softening is indicated when our treated web (which already generally exhibits a useful degree of bonding as a result of the heating and quenching treatment) can be heated to cause further autogenous bonding. The cycling of softening and resolidifying may not continue indefinitely, but it is usually sufficient that the fibers may be initially thermally bonded so that a web of such fibers will be coherent and handleable, heated again if desired to carry out calendaring or other desired operations, and heated again to carry out a three-dimensional reshaping operation to form a nonplanar shape (e.g., to form a molded respirator). We thus can morphologically refine a monocomponent monolayer web in a heating and quenching operation so that the web is capable of developing autogenous bonds at a temperature less than the Nominal Melting Point of the fibers, shape the web over a cup-shaped mold, and subject the thus-shaped web to a molding temperature effective to lastingly convert (viz., reshape) the web into a porous monocomponent monolayer matrix of fibers bonded to one another at at least some points of fiber intersection and having a King Stiffness as recited above. Preferably such reshaping can be performed at a temperature at least 10° C. below the Nominal Melting Point of the polymeric material of the fibers, e.g., at temperatures 15° C., or even 30° C., less than the Nominal Melting Point. Even though a low reshaping temperature is possible, for other reasons the web may be exposed to higher temperatures, e.g., to compress the web or to anneal or thermally set the fibers.

Given the role of the amorphous-characterized phase in achieving bonding of fibers, e.g., providing the material of softening and bonding of fibers, we sometimes call the amorphous-characterized phase the "bonding" phase.

The crystallite-characterized phase of the fiber has its own different role, namely to reinforce the basic fiber structure of the fibers. The crystallite-characterized phase generally can remain unmelted during a bonding or like operation because its melting point is higher than the melting/softening point of the amorphous-characterized phase, and it thus remains as an intact matrix that extends throughout the fiber and supports the fiber structure and fiber dimensions. Thus, although heating the web in an autogenous bonding operation will cause fibers to weld together by undergoing some flow into intimate contact or coalescence at points of fiber intersection, the basic discrete fiber structure is retained over the length of the fibers between intersections and bonds; preferably, the cross-section of the fibers remains unchanged over the length of the fibers between intersections or bonds formed during the operation. Similarly, although calendering our treated web may cause fibers to be reconfigured by the pressure and heat of the calendering operation (thereby causing the fibers to permanently retain the shape pressed upon them during calendering and make the web more uniform in thickness), the fibers generally remain as discrete fibers with a consequent retention of desired web porosity, filtration, and insulating properties.

Given the reinforcing role of the crystallite-characterized phase as described, we sometimes refer to it as the "reinforcing" phase or "holding" phase. The crystallite-characterized phase also is understood to undergo morphological refinement during treatment, for example, to change the amount of higher-order crystalline structure.

Figure 2:
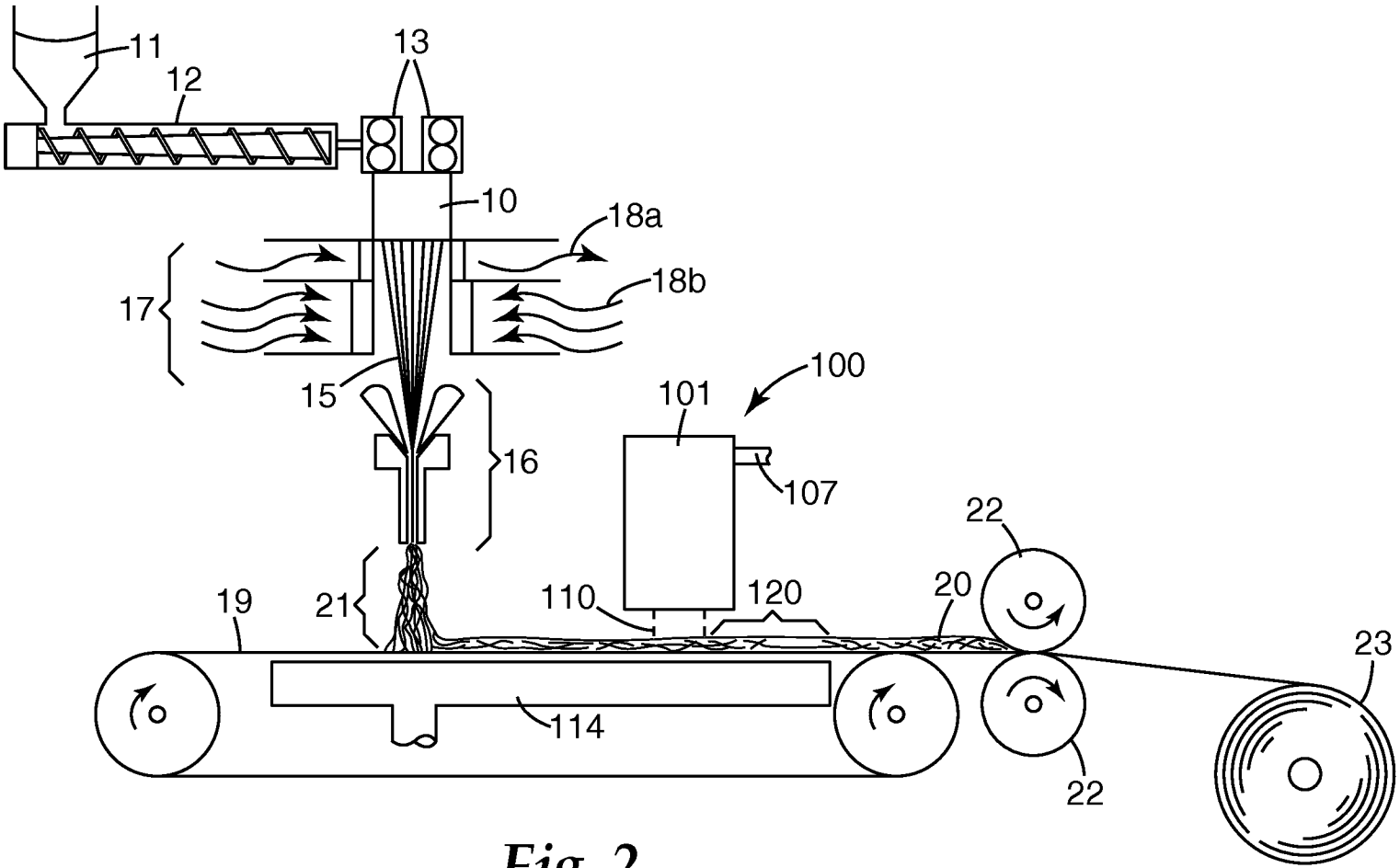
FIG. 2 is a schematic side view of an exemplary process for making a moldable monocomponent monolayer web using meltspinning and a quenched forced-flow heater.
Figure 3:
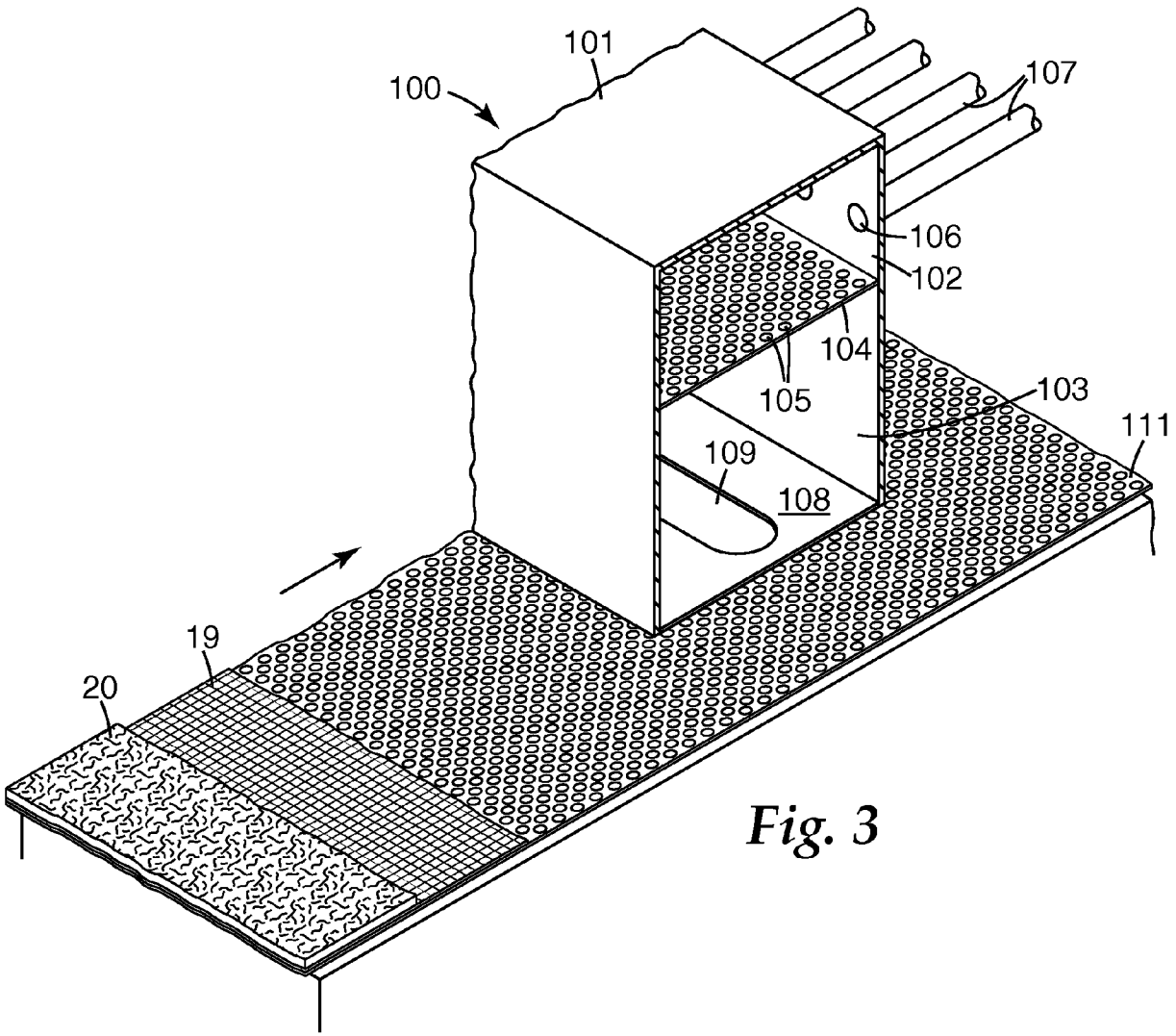
FIG. 3 is a perspective view of a heat-treating part of the apparatus shown in FIG. 2.
Figure 4:
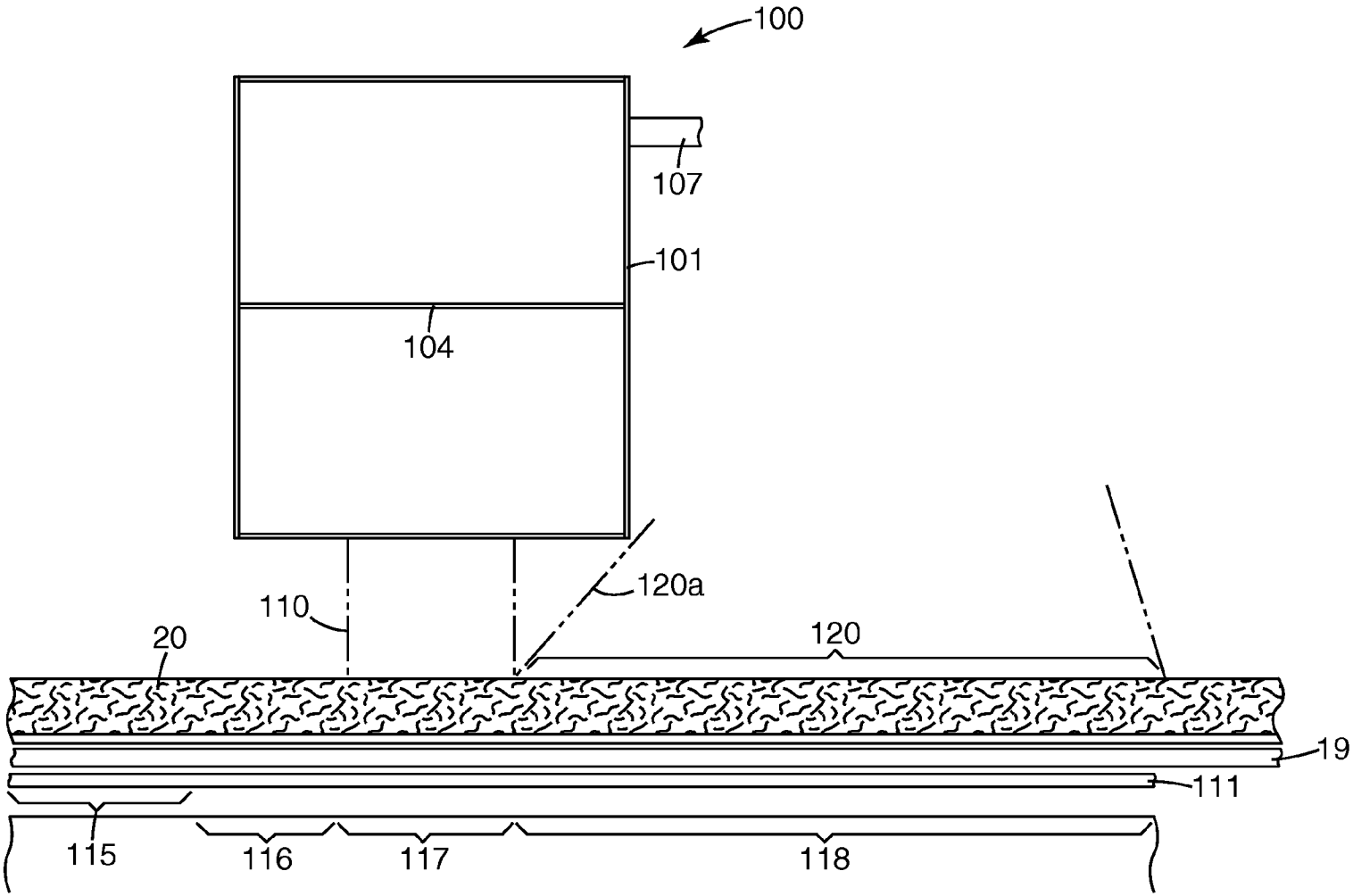
FIG. 4 is a schematic enlarged and expanded view of the apparatus of FIG. 3.

FIG. 2 through FIG. 4 illustrate a process which may be used to make preferred monocomponent monolayer webs. Further details regarding this process and the nonwoven webs so made are shown in U.S. patent application Ser. No. 11/457,899 to Berrigan et al., filed Jul. 17, 2006, entitled Bonded Nonwoven Fibrous Webs Comprising Softenable Oriented Semicrystalline Polymeric Fibers And Apparatus And Methods For Preparing Such Webs, the entire disclosure of which is incorporated herein by reference. In brief summary, as applied to the present invention, this preferred technique involves subjecting a collected web of oriented semicrystalline meltspun fibers which include an amorphous-characterized phase to a controlled heating and quenching operation that includes a) forcefully passing through the web a fluid heated to a temperature high enough to soften the amorphous-characterized phase of the fibers (which is generally greater than the onset melting temperature of the material of such fibers) for a time too short to melt the whole fibers (viz., causing such fibers to lose their discrete fibrous nature; preferably, the time of heating is too short to cause a significant distortion of the fiber cross-section), and b) immediately quenching the web by forcefully passing through the web a fluid having sufficient heat capacity to solidify the softened fibers (viz., to solidify the amorphous-characterized phase of the fibers softened during heat treatment). Preferably the fluids passed through the web are gaseous streams, and preferably they are air. In this context "forcefully" passing a fluid or gaseous stream through a web means that a force in addition to normal room pressure is applied to the fluid to propel the fluid through the web. In a preferred embodiment, the disclosed quenching step includes passing the web on a conveyor through a device (which can be termed a quenched flow heater, as discussed subsequently) that provides a focused or knife-like heated gaseous (typically air) stream issuing from the heater under pressure and engaging one side of the web, with a gas-withdrawal device on the other side of the web to assist in drawing the heated gas through the web; generally the heated stream extends across the width of the web. The heated stream is in some respects similar to the heated stream from a "through-air bonder" or "hot-air knife," though it may be subjected to special controls that modulate the flow, causing the heated gas to be distributed uniformly and at a controlled rate through the width of the web to thoroughly, uniformly and rapidly heat and soften the meltspun fibers to a usefully high temperature. Forceful quenching immediately follows the heating to rapidly freeze the fibers in a purified morphological form ("immediately" means as part of the same operation, i.e., without an intervening time of storage as occurs when a web is wound into a roll before the next processing step). In a preferred embodiment, a gas apparatus is positioned downweb from the heated gaseous stream so as to draw a cooling gas or other fluid, e.g., ambient air, through the web promptly after it has been heated and thereby rapidly quench the fibers. The length of heating is controlled, e.g., by the length of the heating region along the path of web travel and by the speed at which the web is moved through the heating region to the cooling region, to cause the intended melting/softening of the amorphous-characterized phase without melting the whole fiber.

Referring to FIG. 2, fiber-forming material is brought to an extrusion head 10—in this illustrative apparatus, by introducing a polymeric fiber-forming material into a hopper 11, melting the material in an extruder 12, and pumping the molten material into the extrusion head 10 through a pump 13. Solid polymeric material in pellet or other particulate form is most commonly used and melted to a liquid, pumpable state.

The extrusion head 10 may be a conventional spinnerette or spin pack, generally including multiple orifices arranged in a regular pattern, e.g., straight-line rows. Filaments 15 of fiber-forming liquid are extruded from the extrusion head and conveyed to a processing chamber or attenuator 16. The attenuator may for example be a movable-wall attenuator like that shown in U.S. Pat. No. 6,607,624 B2 (Berrigan et al.). The distance 17 the extruded filaments 15 travel before reaching the attenuator 16 can vary, as can the conditions to which they are exposed. Quenching streams of air or other gas 18 may be presented to the extruded filaments to reduce the temperature of the extruded filaments 15. Alternatively, the streams of air or other gas may be heated to facilitate drawing of the fibers. There may be one or more streams of air or other fluid—e.g., a first air stream 18*a* blown transversely to the filament stream, which may remove undesired gaseous materials or fumes released during extrusion; and a second quenching air stream 18*b* that achieves a major desired temperature reduction. Even more quenching streams may be used; for example, the stream 18*b* could itself include more than one stream to achieve a desired level of quenching. Depending on the process being used or the form of finished product desired, the quenching air may be sufficient to solidify the extruded filaments 15 before they reach the attenuator 16. In other cases the extruded filaments are still in a softened or molten condition when they enter the attenuator. Alternatively, no quenching streams are used; in such a case ambient air or other fluid between the extrusion head 10 and the attenuator 16 may be a medium for any change in the extruded filaments before they enter the attenuator.

The filaments 15 pass through the attenuator 16 and then exit onto a collector 19 where they are collected as a mass of fibers 20. In the attenuator the filaments are lengthened and reduced in diameter and polymer molecules in the filaments become oriented, and at least portions of the polymer molecules within the fibers become aligned with the longitudinal axis of the fibers. In the case of semicrystalline polymers, the orientation is generally sufficient to develop strain-induced crystallinity, which greatly strengthens the resulting fibers.

The collector 19 is generally porous and a gas-withdrawal device 114 can be positioned below the collector to assist deposition of fibers onto the collector. The distance 21 between the attenuator exit and the collector may be varied to obtain different effects. Also, prior to collection, extruded filaments or fibers may be subjected to a number of additional processing steps not illustrated in FIG. 2, e.g., further drawing, spraying, etc. After collection the collected mass 20 is generally heated and quenched as described in more detail below; but the mass could be wound into a storage roll for later heating and quenching if desired. Generally, once the mass 20 has been heated and quenched it may be conveyed to other apparatus such as calenders, embossing stations, laminators, cutters and the like; or it may be passed through drive rolls 22 and wound into a storage roll 23.

In a preferred method of forming the web, the mass 20 of fibers is carried by the collector 19 through a heating and quenching operation as illustrated in FIG. 2 through FIG. 4. For shorthand purposes we often refer to the apparatus pictured particularly in FIG. 3 and FIG. 4 as a quenched flow heater, or more simply a quenched heater. The collected mass 20 is first passed under a controlled-heating device 100 mounted above the collector 19. The exemplary heating device 100 comprises a housing 101 that is divided into an upper plenum 102 and a lower plenum 103. The upper and lower plenums are separated by a plate 104 perforated with a series of holes 105 that are typically uniform in size and spacing. A gas, typically air, is fed into the upper plenum 102 through openings 106 from conduits 107, and the plate 104 functions as a flow-distribution means to cause air fed into the upper plenum to be rather uniformly distributed when passed through the plate into the lower plenum 103. Other useful flow-distribution means include fins, baffles, manifolds, air dams, screens or sintered plates, i.e., devices that even the distribution of air.

In the illustrative heating device 100 the bottom wall 108 of the lower plenum 103 is formed with an elongated slot 109 through which an elongated or knife-like stream 110 of heated air from the lower plenum is blown onto the mass 20 traveling on the collector 19 below the heating device 100 (the mass 20 and collector 19 are shown partly broken away in FIG. 3). The gas-withdrawal device 114 preferably extends sufficiently to lie under the slot 109 of the heating device 100 (as well as extending downweb a distance 118 beyond the heated stream 110 and through an area marked 120, as will be discussed below). Heated air in the plenum is thus under an internal pressure within the plenum 103, and at the slot 109 it is further under the exhaust vacuum of the gas-withdrawal device 114. To further control the exhaust force a perforated plate 111 may be positioned under the collector 19 to impose a kind of back pressure or flow-restriction means that contributes to spreading of the stream 110 of heated air in a desired uniformity over the width or heated area of the collected mass 20 and be inhibited in streaming through possible lower-density portions of the collected mass. Other useful flow-restriction means include screens or sintered plates.

The number, size and density of openings in the plate 111 may be varied in different areas to achieve desired control. Large amounts of air pass through the fiber-forming apparatus and must be disposed of as the fibers reach the collector in the region 115. Sufficient air passes through the web and collector in the region 116 to hold the web in place under the various streams of processing air. Sufficient openness is needed in the plate under the heat-treating region 117 and quenching region 118 to allow treating air to pass through the web, while sufficient resistance remains to assure that the air is more evenly distributed.

The amount and temperature of heated air passed through the mass 20 is chosen to lead to an appropriate modification of the morphology of the fibers. Particularly, the amount and temperature are chosen so that the fibers are heated to a) cause melting/softening of significant molecular portions within a cross-section of the fiber, e.g., the amorphous-characterized phase of the fiber, but b) will not cause complete melting of another significant phase, e.g., the crystallite-characterized phase. We use the term "melting/softening" because amorphous polymeric material typically softens rather than melts, while crystalline material, which may be present to some degree in the amorphous-characterized phase, typically melts. This can also be stated, without reference to phases, simply as heating to cause melting of lower-order crystallites within the fiber. The fibers as a whole remain unmelted, e.g., the fibers generally retain the same fiber shape and dimensions as they had before treatment. Substantial portions of the crystallite-characterized phase are understood to retain their pre-existing crystal structure after the heat treatment. Crystal structure may have been added to the existing crystal structure, or in the case of highly ordered fibers crystal structure may have been removed to create distinguishable amorphous-characterized and crystallite-characterized phases.

To achieve the intended fiber morphology change throughout the collected mass 20, the temperature-time conditions should be controlled over the whole heated area of the mass. We have obtained best results when the temperature of the stream 110 of heated air passing through the web is within a range of 5° C., and preferably within 2 or even 1° C., across the width of the mass being treated (the temperature of the heated air is often measured for convenient control of the operation at the entry point for the heated air into the housing 101, but it also can be measured adjacent the collected web with thermocouples). In addition, the heating apparatus is operated to maintain a steady temperature in the stream over time, e.g., by rapidly cycling the heater on and off to avoid over- or under-heating.

To further control heating and to complete formation of the desired morphology of the fibers of the collected mass 20, the mass is subjected to quenching immediately after the application of the stream 110 of heated air. Such a quenching can generally be obtained by drawing ambient air over and through the mass 20 as the mass leaves the controlled hot air stream 110. Numeral 120 in FIG. 4 represents an area in which ambient air is drawn through the web by the gas-withdrawal device through the web. The gas-withdrawal device 114 extends along the collector for a distance 118 beyond the heating device 100 to assure thorough cooling and quenching of the whole mass 20 in the area 120. Air can be drawn under the base of the housing 101, e.g., in the area 120*a* marked on FIG. 4 of the drawing, so that it reaches the web directly after the web leaves the hot air stream 110. A desired result of the quenching is to rapidly remove heat from the web and the fibers and thereby limit the extent and nature of crystallization or molecular ordering that will subsequently occur in the fibers. Generally the disclosed heating and quenching operation is performed while a web is moved through the operation on a conveyor, and quenching is performed before the web is wound into a storage roll at the end of the operation. The times of treatment depend on the speed at which a web is moved through an operation, but generally the total heating and quenching operation is performed in a minute or less, and preferably in less than 15 seconds. By rapid quenching from the molten/softened state to a solidified state, the amorphous-characterized phase is understood to be frozen into a more purified crystalline form, with reduced molecular material that can interfere with softening, or repeatable softening, of the fibers. Desirably the mass is cooled by a gas at a temperature at least 50° C. less than the Nominal Melting Point; also the quenching gas or other fluid is desirably applied for a time on the order of at least one second. In any event the quenching gas or other fluid has sufficient heat capacity to rapidly solidify the fibers. Other fluids that may be used include water sprayed onto the fibers, e.g., heated water or steam to heat the fibers, and relatively cold water to quench the fibers.

Success in achieving the desired heat treatment and morphology of the amorphous-characterized phase often can be confirmed with DSC testing of representative fibers from a treated web; and treatment conditions can be adjusted according to information learned from the DSC testing, as discussed in greater detail in the above-mentioned application Ser. No. 11/457,899. Desirably the application of heated air and quenching are controlled so as to provide a web whose properties facilitate formation of an appropriate molded matrix. If inadequate heating is employed the web may be difficult to mold. If excessive heating or insufficient quenching are employed, the web may melt or become embrittled and also may not take adequate charge.

The disclosed nonwoven webs may have a random fiber arrangement and generally isotropic in-plane physical properties (e.g., tensile strength). In general such isotropic nonwoven webs are preferred for forming cup-shaped molded respirators. The webs may however if desired have an aligned fiber construction (e.g., one in which the fibers are aligned in the machine direction as described in the above-mentioned Shah et al. U.S. Pat. No. 6,858,297) and anisotropic in-plane physical properties.

A variety of polymeric fiber-forming materials may be used in the disclosed process. The polymer may be essentially any semicrystalline thermoplastic fiber-forming material capable of providing a charged nonwoven web which can undergo the above-described heating and quenching operation and which will maintain satisfactory electret properties or charge separation. Preferred polymeric fiber-forming materials are non-conductive semicrystalline resins having a volume resistivity of $10^{14}$ ohm-centimeters or greater at room temperature (22° C.). Preferably, the volume resistivity is about $10^{16}$ ohm-centimeters or greater. Resistivity of the polymeric fiber-forming material may be measured according to standardized test ASTM D 257-93. The polymeric fiber-forming material also preferably is substantially free from components such as antistatic agents that could significantly increase electrical conductivity or otherwise interfere with the fiber's ability to accept and hold electrostatic charges. Some examples of polymers which may be used in chargeable webs include thermoplastic polymers containing polyolefins such as polyethylene, polypropylene, polybutylene, poly(4-methyl-1-pentene) and cyclic olefin copolymers, and combinations of such polymers. Other polymers which may be used but which may be difficult to charge or which may lose charge rapidly include polycarbonates, block copolymers such as styrene-butadiene-styrene and styrene-isoprene-styrene block copolymers, polyesters such as polyethylene terephthalate, polyamides, polyurethanes, and other polymers that will be familiar to those skilled in the art. The fibers preferably are prepared from poly-4-methyl-1 pentene or polypropylene. Most preferably, the fibers are prepared from polypropylene homopolymer because of its ability to retain electric charge, particularly in moist environments.

Electric charge can be imparted to the disclosed nonwoven webs in a variety of ways. This may be carried out, for example, by contacting the web with water as disclosed in U.S. Pat. No. 5,496,507 to Angadjivand et al., corona-treating as disclosed in U.S. Pat. No. 4,588,537 to Klasse et al., hydrocharging as disclosed, for example, in U.S. Pat. No. 5,908,598 to Rousseau et al., plasma treating as disclosed in U.S. Pat. No. 6,562,112 B2 to Jones et al. and U.S. Patent Application Publication No. US2003/0134515 A1 to David et al., or combinations thereof.

Additives may be added to the polymer to enhance the web's filtration performance, electret charging capability, mechanical properties, aging properties, coloration, surface properties or other characteristics of interest. Representative additives include fillers, nucleating agents (e.g., MILLAD™ 3988 dibenzylidene sorbitol, commercially available from Milliken Chemical), electret charging enhancement additives (e.g., tristearyl melamine, and various light stabilizers such as CHIMASSORB™ 119 and CHIMASSORB 944 from Ciba Specialty Chemicals), cure initiators, stiffening agents (e.g., poly(4-methyl-1-pentene)), surface active agents and surface treatments (e.g., fluorine atom treatments to improve filtration performance in an oily mist environment as described in U.S. Pat. Nos. 6,398,847 B1, 6,397,458 B1, and 6,409,806 B1 to Jones et al.). The types and amounts of such additives will be familiar to those skilled in the art. For example, electret charging enhancement additives are generally present in an amount less than about 5 wt. % and more typically less than about 2 wt. %.

The disclosed nonwoven webs may be formed into cup-shaped molded respirators using methods and components that will be familiar to those having ordinary skill in the art. The disclosed molded respirators may if desired include one or more additional layers other than the disclosed monolayer matrix. For example, inner or outer cover layers may be employed for comfort or aesthetic purposes and not for filtration or stiffening. Also, one or more porous layers containing sorbent particles may be employed to capture vapors of interest, such as the porous layers described in U.S. Patent Application Publication 2006/0254427A1, the entire disclosure of which is incorporated herein by reference. Other layers (including stiffening layers or stiffening elements) may be included if desired even though not required to provide a molded respirator having the recited Deformation Resistance DR value.

It may be desirable to monitor flat web properties such as basis weight, web thickness, solidity, EFD, Gurley Stiffness, Taber Stiffness, pressure drop, initial % NaCl penetration, % DOP penetration or the Quality Factor QF, and to monitor molded matrix properties such as King Stiffness, Deformation Resistance DR or pressure drop. Molded matrix properties may be evaluated by forming a test cup-shaped matrix between mating male and female halves of a hemispherical mold having a 55 mm radius and a 310 $cm^3$ volume.

EFD may be determined (unless otherwise specified) using an air flow rate of 32 L/min (corresponding to a face velocity of 5.3 cm/sec), using the method set forth in Davies, C. N., "The Separation of Airborne Dust and Particles", Institution of Mechanical Engineers, London, Proceedings 1B, 1952.

Gurley Stiffness may be determined using a Model 4171E GURLEY™ Bending Resistance Tester from Gurley Precision Instruments. Rectangular 3.8 cm×5.1 cm rectangles are die cut from the webs with the sample long side aligned with the web transverse (cross-web) direction. The samples are loaded into the Bending Resistance Tester with the sample long side in the web holding clamp. The samples are flexed in both directions, viz., with the test arm pressed against the first major sample face and then against the second major sample face, and the average of the two measurements is recorded as the stiffness in milligrams. The test is treated as a destructive test and if further measurements are needed fresh samples are employed.

Taber Stiffness may be determined using a Model 150-B TABER™ stiffness tester (commercially available from Taber Industries). Square 3.8 cm×3.8 cm sections are carefully vivisected from the webs using a sharp razor blade to prevent fiber fusion, and evaluated to determine their stiffness in the machine and transverse directions using 3 to 4 samples and a 15° sample deflection.

Percent penetration, pressure drop and the filtration Quality Factor QF may be determined using a challenge aerosol containing NaCl or DOP particles, delivered (unless otherwise indicated) at a flow rate of 85 liters/min, and evaluated using a TSI™ Model 8130 high-speed automated filter tester (commercially available from TSI Inc.). For NaCl testing, the particles may generated from a 2% NaCl solution to provide an aerosol containing particles with a diameter of about 0.075 μm at an airborne concentration of about 16-23 $mg/m^3$, and the Automated Filter Tester may be operated with both the heater and particle neutralizer on. For DOP testing, the aerosol may contain particles with a diameter of about 0.185 μm at a concentration of about 100 $mg/m^3$, and the Automated Filter Tester may be operated with both the heater and particle neutralizer off. The samples may be loaded to the maximum NaCl or DOP particle penetration at a 13.8 cm/sec face velocity for flat web samples or an 85 liters/min flowrate for molded matrices before halting the test. Calibrated photometers may be employed at the filter inlet and outlet to measure the particle concentration and the % particle penetration through the filter. An MKS pressure transducer (commercially available from MKS Instruments) may be employed to measure pressure drop (ΔP, mm $H_2O$) through the filter. The equation:

$$QF = \frac{-\ln\left(\% \ \frac{\text{Particle Penetration}}{100}\right)}{\Delta P}$$

may be used to calculate QF. Parameters which may be measured or calculated for the chosen challenge aerosol include initial particle penetration, initial pressure drop, initial Quality Factor QF, maximum particle penetration, pressure drop at maximum penetration, and the milligrams of particle loading at maximum penetration (the total weight challenge to the filter up to the time of maximum penetration). The initial Quality Factor QF value usually provides a reliable indicator of overall performance, with higher initial QF values indicating better filtration performance and lower initial QF values indicating reduced filtration performance.

Deformation Resistance DR may be determined using a Model TA-XT2i/5 Texture Analyzer (from Texture Technologies Corp.) equipped with a 25.4 mm diameter polycarbonate test probe. A molded test matrix (prepared as described above in the definition for King Stiffness) is placed facial side down on the Texture Analyzer stage. Deformation Resistance DR is measured by advancing the polycarbonate probe downward at 10 mm/sec against the center of the molded test matrix over a distance of 25 mm. Using five molded test matrix samples, the maximum (peak) force is recorded and averaged to establish the DR value.

The invention is further illustrated in the following illustrative examples, in which all parts and percentages are by weight unless otherwise indicated.

Example 1

Using an apparatus like that shown in FIG. 2 through FIG. 4, monocomponent monolayer webs were formed from FINA 3860 polypropylene having a melt flow rate index of 70 available from Total Petrochemicals, to which was added 0.75 wt. % of CHIMASSORB 944 hindered-amine light stabilizer from Ciba Specialty Chemicals. The extrusion head 10 had 18 rows of 36 orifices each, split into two blocks of 9 rows separated by a 0.63 in. (16 mm) gap in the middle of the die, making a total of 648 orifices. The orifices were arranged in a staggered pattern with 0.25 inch (6.4 mm) spacing. The polymer was fed to the extrusion head at 0.2 g/hole/minute, where the polymer was heated to a temperature of 235° C. (455° F.). Two quenching air streams (**18*b* in FIG. 2; stream 18*a*** was not employed) were supplied as an upper stream from quench boxes 16 in. (406 mm) in height at an approximate face velocity of 83 ft/min (0.42 m/sec) and a temperature of 45° F. (7.2° C.), and as a lower stream from quench boxes 7.75 in.

(197 mm) in height at an approximate face velocity of face velocity of 31 ft/min (0.16 m/sec) and ambient room temperature. A movable-wall attenuator like that shown in Berrigan et al. was employed, using an air knife gap (30 in Berrigan et al.) of 0.030 in. (0.76 mm), air fed to the air knife at a pressure of 12 psig (0.08 MPa), an attenuator top gap width of 0.20 in. (5.1 mm), an attenuator bottom gap width of 0.185 in. (4.7 mm), and 6 in. (152 mm) long attenuator sides (36 in Berrigan et al.). The distance (17 in FIG. 2) from the extrusion head 10 to the attenuator 16 was 31 in. (78.7 cm), and the distance (21 in FIG. 2) from the attenuator 16 to the collection belt 19 was 27 in. (68.6 cm). The meltspun fiber stream was deposited on the collection belt 19 at a width of about 21 in. (about 53 cm). Collection belt 19 moved at a rate of 6 ft/min (about 1.8 meters/min). The vacuum under collection belt 19 was estimated to be in the range of 6-12 in. $H_2O$ (about 1.5-3.0 KPa). The region 115 of the plate 111 had 0.062-inch-diameter (1.6 mm) openings in a staggered spacing resulting in 23% open area; the web hold-down region 116 had 0.062-inch-diameter (1.6 mm) openings in a staggered spacing resulting in 30% open area; and the heating/bonding region 117 and the quenching region 118 had 0.156-inch-diameter (4.0 mm) openings in a staggered spacing resulting in 63% open area. Air was supplied through the conduits 107 at a rate sufficient to present 500 ft.$^3$/min (about 14.2 m$^3$/min) of air at the slot 109, which was 1.5 in. by 22 in. (3.8 by 55.9 cm). The bottom of the plate 108 was ¾ to 1 in. (1.9-2.54 cm) from the collected web 20 on collector 19. The temperature of the air passing through the slot 109 of the quenched flow heater was 164° C. (327° F.) as measured at the entry point for the heated air into the housing 101.

The web leaving the quenching area 120 was bonded with sufficient integrity to be self-supporting and handleable using normal processes and equipment; the web could be wound by normal windup into a storage roll or could be subjected to various operations such as heating and compressing the web over a hemispherical mold to form a molded respirator. The web was hydrocharged with deionized water according to the technique taught in U.S. Pat. No. 5,496,507 (Angadjivand et al.), and allowed to dry. The charged web was evaluated to determine the flat web properties shown below in Table 1A:

TABLE 1A

| Property | Run No. 1-1F | Run No. 1-2F |
|---|---|---|
| Basis weight, gsm | 152 | 164 |
| Solidity, % | 15 | 9.5 |
| Thickness, mm | 1.1 | 1.9 |
| EFD, μm | 11 | 11 |
| Gurley Stiffness, mg | 4557 | 2261 |
| Pressure Drop at 13.8 cm/sec face velocity, mm $H_2O$ | 10 | 7.6 |
| NaCl Penetration at 13.8 cm/sec face velocity, % | 0.64 | — |
| Quality Factor, QF, NaCl challenge | 0.51 | — |
| DOP Penetration at 13.8 cm/sec face velocity, % | 2.7 | — |
| Quality Factor, QF, DOP challenge | 0.34 | — |

The charged flat webs were evaluated using a NaCl challenge to determine the initial quality factor QF, then formed into hemispherical mold samples using the molding conditions shown below in Table 1B. The finished respirators had an approximate external surface area of 145 cm$^2$. The webs were molded with the collector side of the web outside the cup. The resulting cup-shaped molded matrices all had good stiffness as evaluated manually. The molded matrices were load tested using a NaCl challenge aerosol as described above to determine the initial pressure drop and initial % NaCl penetration, and to determine the pressure drop, % NaCl penetration, milligrams of NaCl at maximum penetration (the total weight challenge to the filter up to the time of maximum penetration). The results are shown below in Table 1B:

TABLE 1B

| Run No. | Flat Web from Run No. | Mold Temp, ° C. | Mold time, sec | Mold gap, mm | ΔP Initial, mm $H_20$ (NaCl) | % NaCl Pen., Initial | ΔP at Max Pen., mm $H_20$ | % NaCl Pen., Max | Max Pen, mg NaCl Challenge |
|---|---|---|---|---|---|---|---|---|---|
| 1-1M | 1-1F | 280 | 5 | 0 | 7.7 | 0.46 | 13.6 | 2.1 | 44.7 |
| 1-2M | 1-1F | 280 | 5 | 0.5 | 7.7 | 0.69 | 12.3 | 2.3 | 32.4 |
| 1-3M | 1-1F | 300 | 5 | 0 | 7.9 | 0.75 | 12.8 | 2.5 | 36.0 |
| 1-4M | 1-1F | 300 | 5 | 0.5 | 8.4 | 0.57 | 12.7 | 1.5 | 37.6 |
| 1-5M | 1-1F | 300 | 10 | 0 | 7.9 | 0.82 | 12.2 | 2.3 | 40.8 |
| 1-6M | 1-1F | 300 | 10 | 0.5 | 7.6 | 0.66 | 11.2 | 1.3 | 47.9 |
| 1-7M | 1-1F | 310 | 5 | 0 | 8.1 | 0.11 | 13.9 | 0.4 | 63.6 |
| 1-8M | 1-1F | 310 | 5 | 0.5 | 7.9 | 0.13 | 12.8 | 0.5 | 48.8 |
| 1-9M | 1-1F | 320 | 5 | 0.5 | 8.8 | 0.61 | 14.8 | 1.8 | 34.8 |
| 1-10M | 1-1F | 320 | 25 | 0 | 9.0 | 0.21 | 15.0 | 0.9 | 50.5 |
| 1-11M | 1-1F | 320 | 25 | 0.5 | 8.4 | 0.19 | 14.7 | 0.8 | 59.8 |
| 1-12M | 1-1F | 330 | 0 | 0 | 8.8 | 0.92 | 15.8 | 2.3 | 39.3 |
| 1-13M | 1-1F | 330 | 5 | 0.5 | 8.2 | 0.25 | 12.3 | 0.9 | 49.3 |
| 1-14M | 1-1F | 330 | 25 | 0.5 | 8.4 | 0.36 | 14.1 | 1.4 | 48.9 |
| 1-15M | 1-1F | 340 | 5 | 0.5 | 6.1 | 0.72 | 8.2 | 0.8 | 70.5 |
| 1-16M | 1-2F | 300 | 5 | 0 | 6.8 | 1.39 | 12.6 | 3.3 | 39.4 |
| 1-17M | 1-2F | 300 | 5 | 0 | 7.0 | 1.60 | 13.3 | 3.9 | 41.0 |
| 1-18M | 1-2F | 300 | 5 | 0.5 | 7.1 | 1.12 | 13.2 | 3.1 | 44.7 |
| 1-19M | 1-2F | 300 | 10 | 0.5 | 7.4 | 2.06 | 12.2 | 3.7 | 35.9 |
| 1-20M | 1-2F | 300 | 10 | 0 | 6.8 | 1.26 | 12.5 | 2.4 | 41.4 |
| 1-21M | 1-2F | 310 | 10 | 0 | 6.7 | 0.26 | 12.7 | 1.6 | 52.0 |
| 1-22M | 1-2F | 320 | 5 | 0.5 | 7.1 | 1.30 | 13.0 | 4.0 | 45.9 |
| 1-23M | 1-2F | 330 | 5 | 0.5 | 7.2 | 1.17 | 14.4 | 3.2 | 47.3 |

The results in Table 1B show that the webs of Run Nos. 1-1F and 1-2F provide monocomponent, monolayer molded matrices which should pass the N95 NaCl loading test of 42 C.F.R. Part 84.

Five samples each of the molded matrices of Run Nos. 1-5M and 1-20M were evaluated to determine King Stiffness. The King Stiffness values are shown below in Table 1C:

TABLE 1C

| Run No. | King Stiffness, N |
|---|---|
| 1-5M | 6.18 |
| 1-20M | 1.96 |

Example 2

Using the general method of Example 1 except as otherwise indicated below, two monocomponent monolayer webs were formed from FINA 3860 polypropylene to which was added 1.5 wt. % tristearyl melamine (Run 2-1) or 0.5 wt. % CHIMASSORB 944 hindered-amine light stabilizer (Run 2-2). A movable-wall attenuator like that shown in U.S. Pat. No. 6,607,624 B2 (Berrigan et al.) was employed, using a bottom gap width (34 in Berrigan et al. FIG. 2) of 0.18 inch (4.6 mm). Based on similar samples, the fibers were estimated to have a median fiber diameter of approximately 11 μm. The collection belt 19 moved at a rate of 6 fpm (0.030 m/s) for the Run No. 2-1 web and 6.5 fpm (0.033 m/s) for the Run No. 2-2 web. The temperature of the air passing through slot 109 was 160° C. (320° F.). The web leaving the quenching area 120 was bonded with sufficient integrity to be self-supporting and handleable using normal processes and equipment. Webs with a basis weight of 160 gsm were obtained. The webs were run through a nip of two stainless steel 10 in. (254 mm) diameter calendar rolls at 5 feet/min. (0.025 m/s). The calendar gap was maintained at 0.020 inch (0.51 mm), and both calendar rolls were heated to 295° F. (146° C.). The calendared webs were hydrocharged with distilled water according to the technique taught in U.S. Pat. No. 5,496,507 (Angadjivand et al.) and allowed to dry by hanging on a line overnight at ambient conditions, and were then formed into smooth, cup-shaped molded respirators using a heated, hydraulic molding press. Using an NaCl challenge, the charged webs had initial Quality Factor QF values of 0.47 (Run No. 2-1) and 0.71 (Run No. 2-2). Molding was performed at 305° F. (152° C.), using a 0.020 inch (0.51 mm) mold gap and a 5 second dwell time. The finished respirators had an approximate external surface area of 145 $cm^2$. The webs were molded with the collector side of the web inside the cup. The resulting cup-shaped molded matrices had good stiffness as evaluated manually. The molded matrices were load tested using a NaCl challenge aerosol as described above to determine the initial pressure drop and initial % penetration, and to determine the pressure drop, % NaCl penetration and milligrams of NaCl at maximum penetration (the total weight challenge to the filter up to the time of maximum penetration). The results are shown below in Table 2:

TABLE 2

| Run No. | ΔP Initial, mm $H_20$ | % Pen., Initial | ΔP at Max Pen., mm $H_20$ | % Pen., Max | Max Pen, mg NaCl Challenge |
|---|---|---|---|---|---|
| 2-1 | 9.0 | 1.4 | 12.4 | 2.5 | 77.8 |
| 2-2 | 7.7 | 0.43 | 12.7 | 0.7 | 69.5 |

The results in Table 2 show that the webs of Run Nos. 2-1 and 2-2 provide monocomponent, monolayer molded matrices which should pass the N95 NaCl loading test of 42 C.F.R. Part 84.

A number of embodiments of the invention have been described. Nevertheless, it will be understood that various modifications may be made without departing from the invention. Accordingly, other embodiments are within the scope of the following claims.

We claim:

1. A molded respirator comprising a cup-shaped porous monocomponent monolayer matrix of continuous charged monocomponent polymeric fibers, the fibers being partially crystalline and partially amorphous oriented meltspun polymeric fibers of the same polymeric composition bonded to one another at at least some points of fiber intersection and the matrix having a King Stiffness greater than 1 N.

2. A molded respirator according to claim 1 wherein the fibers are autogenously bonded.

3. A molded respirator according to claim 1 wherein the matrix has a basis weight of about 80 to about 250 gsm.

4. A molded respirator according to claim 1 wherein the matrix has an Effective Fiber Diameter of about 5 to about 40 μm.

5. A molded respirator according to claim 1 wherein the matrix has a King Stiffness of at least 2 N.

6. A molded respirator according to claim 1 which exhibits less than 5% maximum penetration when exposed to a 0.075 μm sodium chloride aerosol flowing at 85 liters/min.

7. A molded respirator according to claim 1 which exhibits less than 1% maximum penetration when exposed to a 0.075 μm sodium chloride aerosol flowing at 85 liters/min.

8. A molded respirator according to claim 1 wherein the polymer is polypropylene.

* * * * *